US005638576A

United States Patent [19]

Mutone

[11] Patent Number: 5,638,576

[45] Date of Patent: Jun. 17, 1997

[54] DOOR KNOB LEVER

[75] Inventor: Edward J. Mutone, Pomona, N.Y.

[73] Assignee: Independent Living Products LLC, Congers, N.Y.

[21] Appl. No.: 561,426

[22] Filed: Nov. 21, 1995

[51] Int. Cl.[6] ..... B25G 3/28

[52] U.S. Cl. ..... 16/114 R; 16/DIG. 30

[58] Field of Search ..... 16/114 R, DIG. 24, 16/DIG. 25, DIG. 30; 292/336.3, 347, DIG. 2

[56] References Cited

U.S. PATENT DOCUMENTS

| | | | |
|---|---|---|---|
| 1,067,575 | 7/1913 | Anderson | 16/114 R |
| 1,746,288 | 2/1930 | Shephard | 16/114 R |
| 4,223,931 | 9/1980 | Neary | 16/DIG. 30 |
| 4,504,087 | 3/1985 | Pennington | 16/DIG. 30 |
| 4,783,883 | 11/1988 | Szalay | 16/DIG. 30 |
| 4,913,479 | 4/1990 | Allison . | |
| 5,231,731 | 8/1993 | Jones, Jr. . | |
| 5,522,116 | 6/1996 | Enneking | 16/114 R |

*Primary Examiner*—M. Rachuba
*Assistant Examiner*—Donald M. Gurley
*Attorney, Agent, or Firm*—Stanley J. Yavner

[57] ABSTRACT

A door knob lever is described, for use primarily by disabled persons, as including a rotatable hook at one end thereof for hooking around the base of a common door knob. A right angle or arcuate shaped bracket is also included, with the rotation of the hook taking place with respect to the bracket. The other end of the lever provides a handle for enabling the gripping of the lever, so that the user grips the handle of the lever, swings it to cause the hook to encircle the door knob at its base, rotates the bracket to engage the door knob gripping surface and then rotates the lever to cause the door knob to rotate.

6 Claims, 2 Drawing Sheets

3
2
40
22
20
10
24
34
32
28
12

36
36'
34
4
26
22
24
18
16
14
20
32
30
28
38
40
42
12

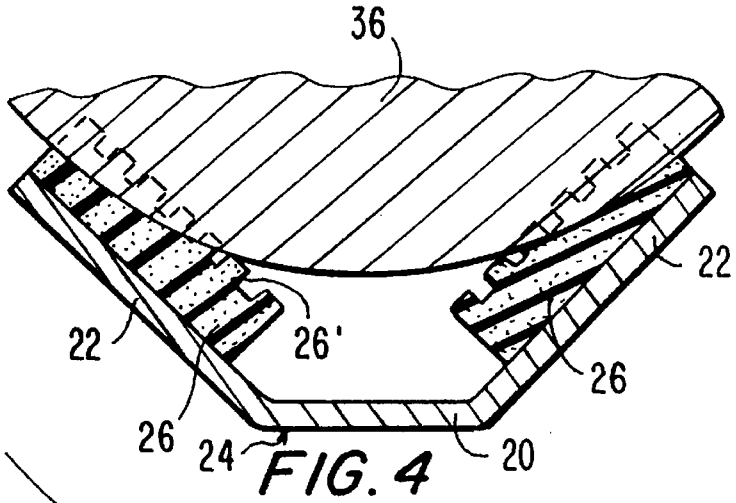
FIG. 4
FIG. 3
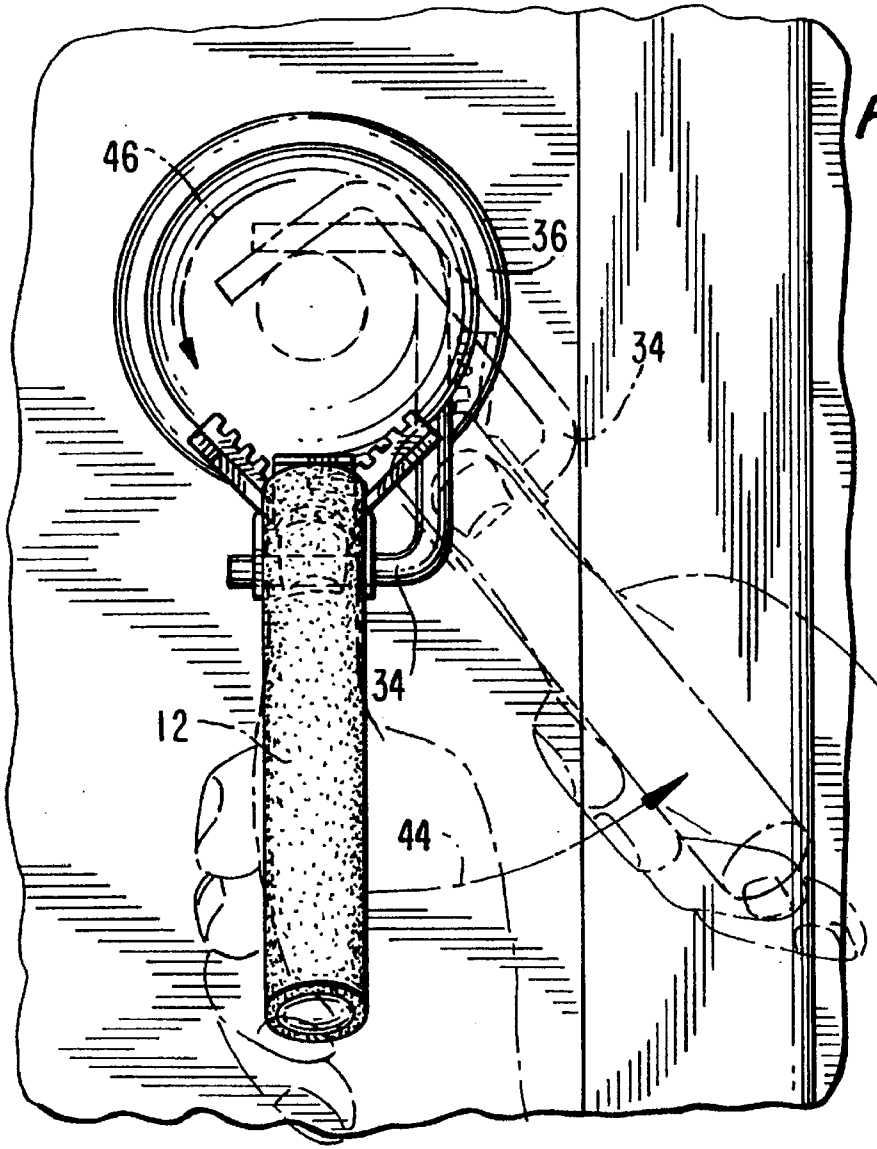

DOOR KNOB LEVER

FIELD OF THE INVENTION

This invention relates primarily to door knob attachments and more particularly to an improved door knob attachment for use by disabled persons, who have a disability which relates to grasping and turning by use of a hand and/or manipulation with fingers.

BACKGROUND OF THE INVENTION

During the past half century, a signifcant effort has been made by industry to accommodate many different disabilities, from which so many of the human race suffer. Particularly with respect to those disabilities which prevent a disabled person from using his or her hands, the disability is particularly confining, in terms of those activities in which a person must engage a number of times each and every day of his or her life. One such activity is the opening of unlocked doors, which requires only the turning of a door knob handle.

Disability sensitive industry has attacked this problem in a number of different ways; for instance, the door knob especially has been adjusted in shape to attempt to accommodate disabled persons who might not be able to grip and turn a standard door knob. This has proven to be particularly unhelpful with respect to the general problem.

Another manner of approach to the general problem is illustrated by the patent granted to Robert L. Jones, Jr., U.S. Pat. No. 5,231,731 granted on Aug. 3, 1993. In that patent, Jones discloses and claims a door knob attachment which requires set screws to attach the appliance to existing door knobs. In fairness, what was envisioned by Jones was the a persons other than the disabled one would make the attachment, and thereby present an attachment with a lever for a standard door knob, which can be conveniently used by the disabled person. What is lacking in the Jones appliance, is a sense of how many different door knobs, in the abode of the disabled person must be converted to make the item useful by the disabled person. Another feature lacking in the Jones structure is assistance for the disabled person when he or she is not in or her own abode.

Both of the problems indicated as lacking in the Jones invention are still present, although in a different structure, as presented by Allison in U.S. Pat. No. 4,913,479 issued on Apr. 30, 1990. The Allison structure also lacks portability, and further requires at least one set screw manipulation for attaching the structure, with a lever, to a door knob. Also, Allison shows a rather complex structure.

It is noted that Jones further suffers from the disadvantage that it is useful only in connection with a very narrow range of door knob sizes, whereas Allison is more adaptable to different sizes.

OBJECTS OF THE INVENTION AND SUMMARY THEREOF

Accordingly, a primary object of the present invention is to provide a door knob attachment, having a lever for use by a disabled person, which is adaptable to different sized door knobs and may be carried from place-to-place by the disabled person, for attachment and use by that person without assistance.

A further and more particular object of the present invention is to provide a door knob lever attachment, which is not only portable, and adaptable to different sized door knobs, but also is useable and operable by the disabled person himself or herself.

A still further object of the present invention is to provide a door knob lever attachment, useable and attachable by a disabled person, and also which is simple and yet efficient in its structure and in the accomplishment of its objectives.

These and other objects of the present invention are provided in a door knob attachment lever which features a first end having a handle, a second end for rotatable attachment of a hook, with said hook being rotatable with respect to a right angle bracket located between the point of attachment of said hook and said handle. More particularly, the right angle bracket, in the preferred embodiment, is in actuality a truncated right angle bracket, defining on its inner surface a substance or other means for gripping with the outermost surface of the door knob. In alternative embodiments, an arcuate bracket is provided, in lieu of the right angle bracket, or, in a still further alternative structure, a full right angle bracket is provided.

BRIEF DESCRIPTION OF THE DRAWINGS

Other objects, features and advantages will become apparent by the following more detailed description of a preferred, but nonetheless illustrative embodiment, with reference to the accompanying drawings, wherein:

FIG. 3 is a view taken along the line 3—3 of FIG. 1, and also showing, in ghost lines, a view of the present invention after the door knob is turned using the present invention; and FIG. 4 is a partial, sectional view taken along the line 4—4 of FIG. 2 and showing particularly the truncated right angle bracket of the present invention, in its gripping position with respect to the door knob.

DETAILED DESCRIPTION OF THE PREFERRED EMBODIMENT

Figure 1:
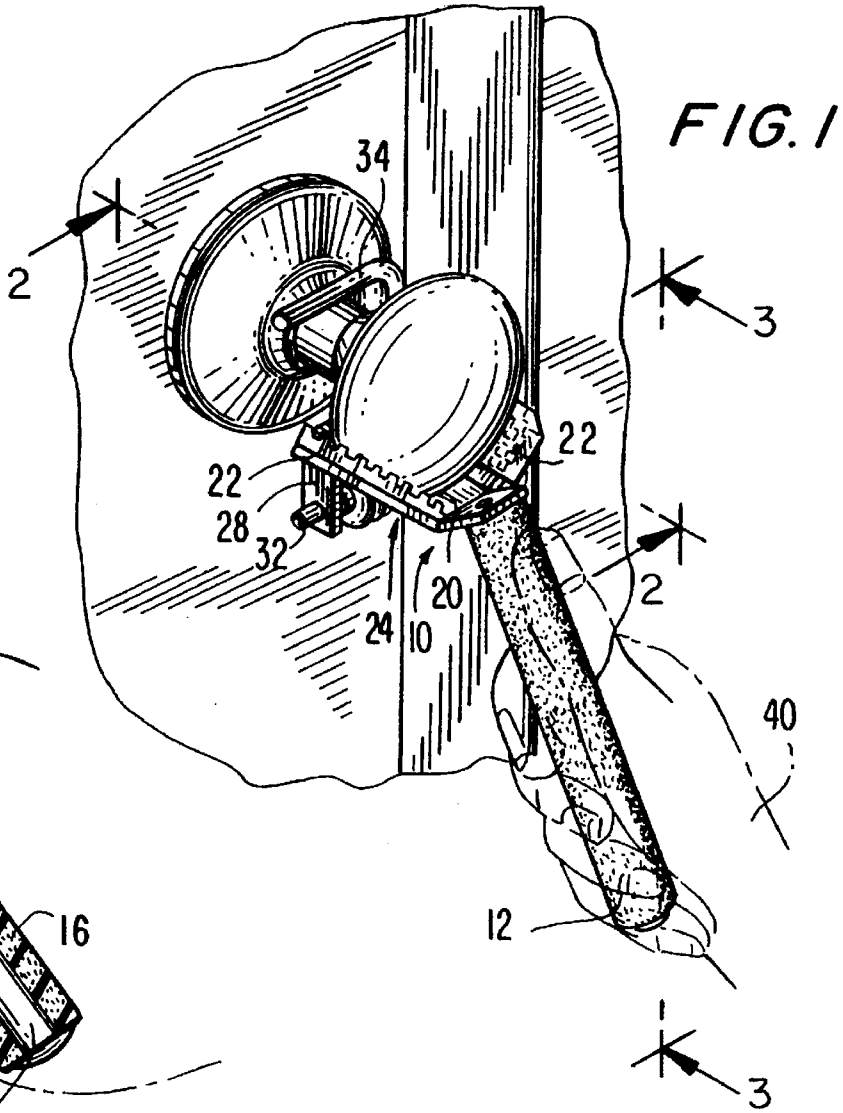
FIG. 1 is an isometric view of the setting or environment for the present invention, including a standard door knob, and showing the final position in the use of the present invention with the hook thereof encircling the base of the door knob, and the lever handle and bracket rotated to the door knob-turning position.
Figure 2:
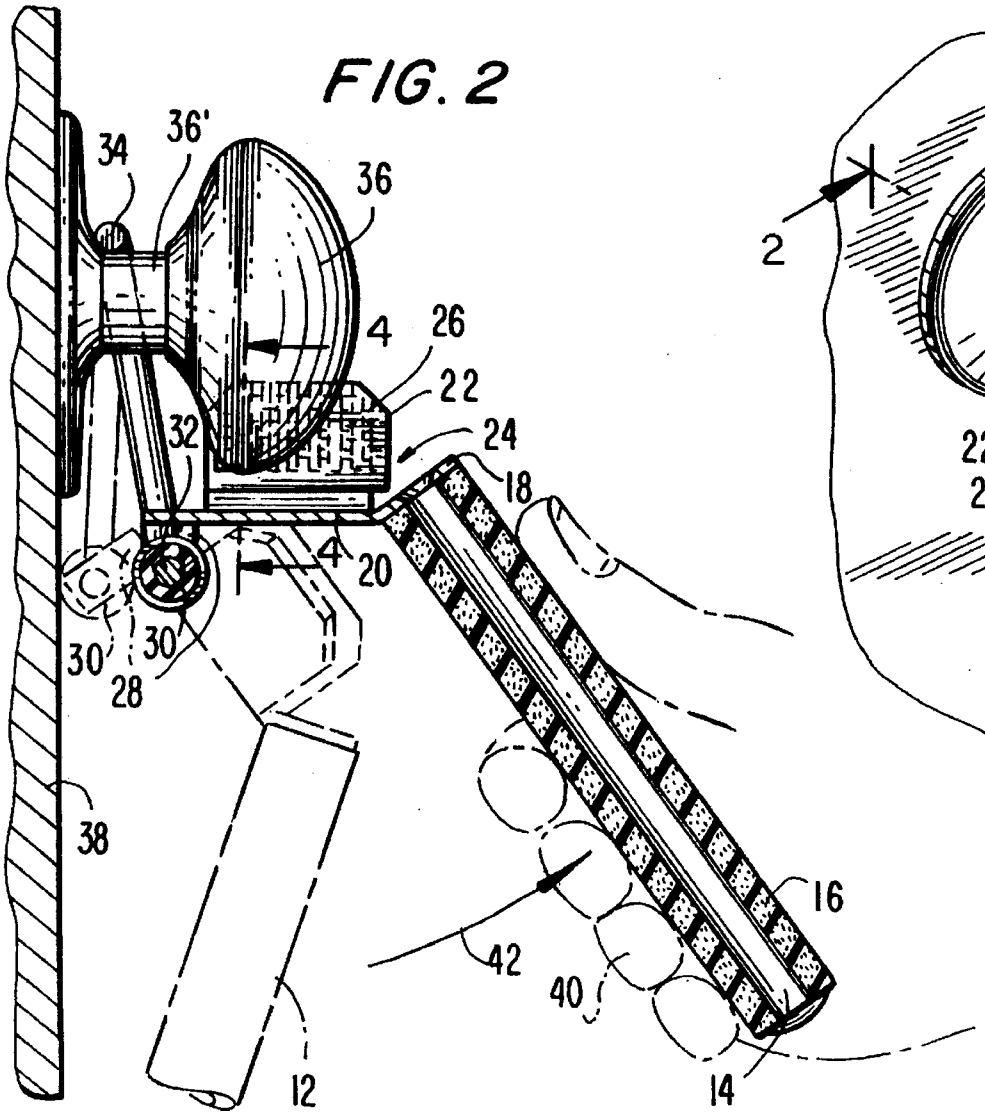
FIG. 2 is a sectional view, taken along the line 2—2 of FIG. 1 and showing, in ghost lines, the initial position, during use of the present invention, with the hook encircling the base of the door knob, and the bracket and lever thereof not yet rotated to grasp and turn the door knob.

Referring to FIG. 1, a door knob attachment lever generally designated 10, at one end, is shown to include lever handle 12, which includes a generally cylindrical element 14 covered by a generally resilient material 16, as shown particularly in FIG. 2. Now referring to FIGS. 1 and 2 together, handle 12 is shown to terminate, at its end opposite to its free end, in a handle plate 18, rigidly connected at an angle to bracket plate 20.

Upwardly angularized with respect to, and rigidly connected to, bracket plate 20 are two angle plates 22, forming with bracket plate 20 a truncated right angle bracket structure generally designated 24. The truncation of the right angle bracket 24 is accomplished by bracket plate 20, and cushioning material 26 lines the insides of angle plates 22 and defines a waffle-like surface 26', the function of which will become apparent by the following description:

Hook bracket element 28 depends from the end of bracket plate 20, which is opposite to where handle plate 18 is connected. Hook bracket element 28 defines, in its U-shaped extensions a pair of holes 30, through which hook axle 32 is placed. At the center of hook axle 32, and within the U-shape of hook bracket element 28, a hook 34 is connected rotatably.

The foregoing structure, as described, is intended for selective connection to a door knob 36 in order to facilitate the selective engagement with and use of a door knob 36 by a disabled person, who requires the assistance of this structure for purposes of opening a door 38. The angular arrangement of the various elements of the structure 10, and the rotatable connection of hook 34 therein, are calculated to aid a disabled person with less than full use of the hands and fingers (shown in ghost lines as 40), to use the structure in a portable manner; i.e. the user 40 carries the door knob lever with him or her, and without assistance, can usually manipulate most door knobs in order to open most unlocked doors.

In order to provide a full understanding of the structure of the present invention, and the use thereof, a series of use steps are now provided. The user 40, in any reasonable manner within his or her capability, grasps handle 12, and then places or throws hook 34, so that hook 34 goes around the narrower base 36' of door knob 36. At this point, the probable arrangement of parts of the door knob lever 10 is as shown in ghost lines in FIG. 2. As shown in the drawings, and as shown particularly in FIG. 2, the user then moves handle 12 in the direction of arrow 42 (as in a lifting motion). This motion places bracket 24 to the position shown in FIG. 4, with respect to door knob 36. The solid lines in all drawings also illustrate this position.

At this point in the operation of door knob lever 10, the hook 34 encircles the base 36' of door knob 36 and bracket 24 firmly grasps, with the aid of material 26, door knob 36 at two points, as shown particularly in FIG. 4. Material 26, it is recommended, is composed of a plastic sponge-like material in order to most effectively accomplish the grasping function; and yet, without in any way marring or damaging door knob 36.

The turning of the door knob 36, in order to unlatch and open door 38, is accomplished by the rotating motion in the direction of arrow 44, as shown in FIG. 3. Door knob 36 is thereby turned in the rotating direction depicted by arrow 46 in FIG. 3.

In this manner, a disabled person, generally without any assistance, can operate the myriad of door knobs with which he or she is confronted on a day-to-day basis. This function and capability is provided with a structure, which is portable and fully operable with respect to any one of a number of door knob sizes and shapes.

As a first alternative structure, it might enhance the use of this invention to provide, for use in some circumstances, a flexible hand grip loop, for connection to, or through a hole in, handle 12.

Although the invention has been described in the foregoing with respect to a particular preferred, and one alternative, embodiment thereof, a range of alternative structures are also contemplated; for instance, the shape of bracket 24 is varied to a full right angle bracket (not truncated), or an arcuate bracket (not shown) is used, both of which operate in the same manner. The full scope of the protection for the invention herein is to be dictated and guided only by the following claims:

What is claimed is:

1. A door knob attachment lever, primarily for use by a disabled person, for gripping and turning a door knob having a base, comprising a handle, a bracket having two ends and a hook, said bracket located between said handle and said hook, means rotatably attaching said hook to one end of said bracket and means attaching said handle to the other end of said bracket, whereby said hook is for encircling said base of said door knob, and said bracket for gripping said door knob in order to turn said door knob by turning said handle.

2. The invention according to claim 1, wherein said bracket is a truncated right angle bracket having two angle plates in planes perpendicular to each other, a cushioning material lining said plates and for gripping contact with said door knob.

3. The invention according to claim 1, wherein said rotatably attaching means includes a hook bracket element extending from said bracket in a direction away from said handle, said hook bracket defining a U-shape and defining openings therein, an axle extending through said openings and said hook being rotatably attached to said axle.

4. The invention according to claim 1, wherein said handle includes a cylindrical element handle base, and a resilient material encircles said base.

5. The invention according to claim 1, wherein said bracket and said handle are rigidly attached.

6. The invention according to claim 2, wherein said cushioning material defines a waffle-like surface for gripping said door knob.

* * * * *